US010082351B2

(12) United States Patent
Lytinas

(10) Patent No.: US 10,082,351 B2
(45) Date of Patent: Sep. 25, 2018

(54) PROPELLANT-BASED PROJECTILE WEAPONS COMPRISING RECOIL INVERSION ASSEMBLIES

(71) Applicant: Michael Lytinas, Boston, MA (US)

(72) Inventor: Michael Lytinas, Boston, MA (US)

( * ) Notice: Subject to any disclaimer, the term of this patent is extended or adjusted under 35 U.S.C. 154(b) by 0 days.

(21) Appl. No.: 15/618,111

(22) Filed: Jun. 8, 2017

(65) Prior Publication Data

US 2017/0356705 A1 Dec. 14, 2017

Related U.S. Application Data

(60) Provisional application No. 62/347,124, filed on Jun. 8, 2016.

(51) Int. Cl.
*F41A 3/78* (2006.01)
*F41A 3/86* (2006.01)
*F41A 19/30* (2006.01)

(52) U.S. Cl.
CPC ..... *F41A 3/86* (2013.01); *F41A 19/30* (2013.01)

(58) Field of Classification Search
CPC ..... F41A 3/86; F41A 19/30
USPC ..... 89/198, 14.3
See application file for complete search history.

(56) References Cited

U.S. PATENT DOCUMENTS

| | | | | | |
|---|---|---|---|---|---|
| 642,018 | A * | 1/1900 | Ternstrom | F41A 5/08 | 42/25 |
| 830,511 | A * | 9/1906 | Lehmann | F41A 3/40 | 89/149 |
| 1,344,499 | A * | 6/1920 | Gabbett-Fairfax | F41A 5/00 | 89/14.3 |
| 1,451,443 | A * | 4/1923 | Fowler | F41A 3/38 | 42/16 |
| 3,757,636 | A * | 9/1973 | Chiabrandy | F41A 3/82 | 89/169 |

* cited by examiner

*Primary Examiner* — Samir Abdosh
(74) *Attorney, Agent, or Firm* — Notaro, Michalos & Zaccaria P.C.

(57) ABSTRACT

The present invention is directed to novel recoil inversion assemblies, which reduce recoil generated by blowback of the propellant gases, as well as their use in propellant-based projectile weapons. Such novel weapons afford reduced recoil, muzzle flip, and muzzle climb, and therefore exhibit improved manageability as compared with current related weapons, particularly when utilizing high powered ammunition. In particular, the recoil inversion assemblies of the present invention further comprise novel delayed-blowback assemblies affording utility with larger caliber ammunition.

20 Claims, 5 Drawing Sheets

PROPELLANT-BASED PROJECTILE WEAPONS COMPRISING RECOIL INVERSION ASSEMBLIES

RELATED APPLICATIONS

This application claims the benefit of priority from U.S. Provisional Patent Application No. 62/347,124, filed on Jun. 8, 2006, the entirety of which is incorporated herein by reference.

BACKGROUND OF THE INVENTION

Recoil and muzzle redirection, such as muzzle flip and muzzle climb, are significant factors affecting the manageability of today's propellant-based weapons. Management of these factors has been a goal of weapon manufacturers since their inception. In fact, existing strategies for compensation of these factors have involved modifications by the user to both behavior, such as wearing gloves or shooting a smaller cartridge, as well as modifications to the weapon itself.

Weapon modifications used for compensation of these factors have primarily involved devices for redirecting the propellant gases. Moreover, such redirection has been accomplished by attachment of devices to the end of the barrel, for example, using muzzle brakes and other recoil compensators such as suppressors, which by consequence results in the extension of the barrel; generally changing the "feel" and handling of the weapon. As such, brakes and compensators, which add length, diameter, and mass to the muzzle end of a firearm, change the balance of the weapon and may, in fact, interfere with accuracy as muzzle rise will occur when the brake is removed and shooting without the brake can throw off the strike of the round. Furthermore, additional disadvantages of brakes and compensators include the damaging effects of the redirected propellant that may result not only in increased sound pressure levels that can damage ears, but also the blast may direct damaging pressure waves at the shooter and increase lead exposure for lead loaded smoke plumes that are normally projected away from the shooter become partially redirected outward to the side, or even sometimes at partially backward angles toward the shooter. Such redirected propellant also has an added effect of causing dust and debris clouds that impair visibility and reveal one's position, as well as being a hazard to individuals without eye protection.

Recent alternate solutions to recoil and muzzle redirection have addressed the internal mechanics of the weapon rather than providing attachment devices. Such solutions utilize the ability of the shooter to absorb the recoil force by partially revectoring the force of the recoil backwards and downwards into the shooter, i.e., creating a force to partially counter the muzzle redirection. In essence, these solutions only reduce, in part, the consequence of recoil rather than the recoil itself; and rely heavily on the shooter's ability to control the recoil.

As such, there is a need for new propellant based projectile weapons that reduce recoil as well as the consequences of recoil, including muzzle flip and muzzle climb, which tend to decrease manageability of current weapons, particularly when utilizing high powered ammunition.

SUMMARY OF THE INVENTION

Accordingly, the present invention is directed to novel recoil inversion assemblies, which reduce recoil generated by blowback of the propellant gases, as well as their use in propellant-based projectile weapons. Such novel weapons afford reduced recoil, muzzle flip, and muzzle climb, and therefore exhibit improved manageability as compared with current related weapons, particularly when utilizing high powered ammunition. In particular, the recoil inversion assemblies of the present invention further comprise novel delayed-blowback assemblies affording utility with larger caliber ammunition.

Accordingly, one aspect of the invention provides a recoil inversion assembly of a propellant-based projectile (PBP) weapon designed with an inversion construct. The inversion construct comprises an inversion lever and a fulcrum, wherein the inversion lever is linked on one end of the inversion lever through a first lever-pivot pin to one or more transfer arms linked to a striker through a striker-pivot pin, and wherein the opposite end of the inversion lever is linked through a second lever-pivot pin to one or more transfer arms linked to a slide suitable for sliding along a recoil guide rod and compressing a recoil spring. The blowback from a projectile propelled from a barrel of a propellant-based projectile (PBP) weapon is transferred through the recoil inversion assembly to a recoil spring positioned at an angle that is acute to the barrel, and thereby inverting the recoil.

Another aspect of the present invention provides a propellant-based projectile (PBP) weapon with recoil inversion comprising a frame encapsulating: a barrel through which rapid expansion of gases are released for propelling a projectile out of the end; a striker assembly comprising a striker aligned to the end of the barrel for striking the igniter of propellant used to propel the projectile out of the end of the barrel; a trigger assembly that actuates the striker to strike the igniter of the propellant; and a recoil inversion assembly designed with an inversion construct. The inversion construct comprises an inversion lever and a fulcrum, wherein the inversion lever is linked on one end of the inversion lever through a first lever-pivot pin to one or more transfer arms linked to the striker through a striker-pivot pin, and wherein the opposite end of the inversion lever is linked through a second lever-pivot pin to one or more transfer arms linked to a slide suitable for sliding along the recoil guide rod and compressing the recoil spring. The blowback from the projectile propelled through the barrel is transferred through the recoil inversion assembly to the recoil spring positioned at an angle that is acute to the barrel, and thereby inverting the recoil.

BRIEF DESCRIPTION OF THE FIGURES

Advantages of the present apparatus will be apparent from the following detailed description, which description should be considered in combination with the accompanying figures, which are not intended limit the scope of the invention in any way.

DETAILED DESCRIPTION OF THE INVENTION

Figure 1:
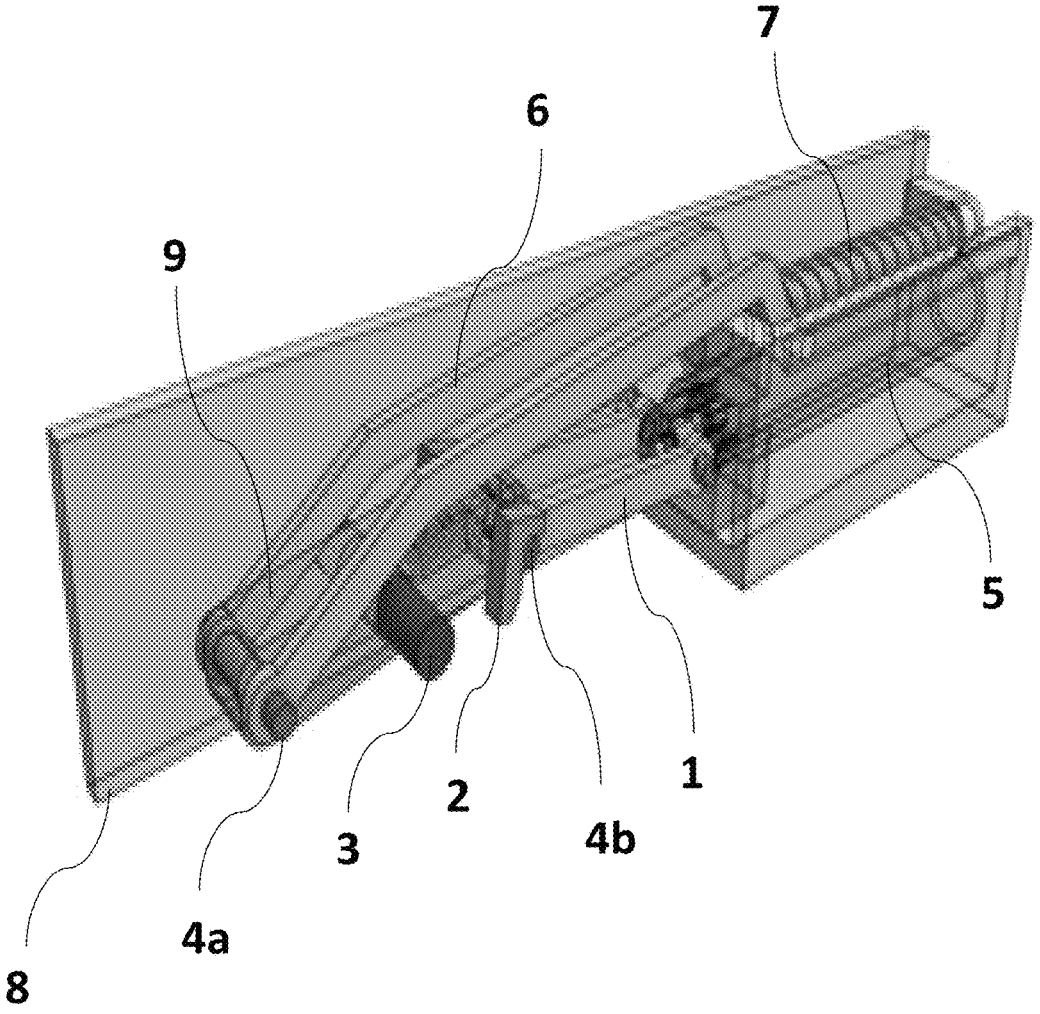
FIG. 1 is a rear angle side perspective view of a particular embodiment of a recoil inversion assembly inside a PBP weapon of the invention comprising a delayed-blowback assembly of the present invention depicted with a striker in firing position.

The manageability of a propellant-based projectile (PBP) weapon is one of the major characteristics for a user in selecting, and then controlling the firing of the weapon. Recoil and muzzle redirection, such as muzzle flip and muzzle climb, are significant factors affecting the manageability of today's propellant-based weapons, as such the recoil inversion assemblies of the present invention provide a novel means of management of these factors.

Accordingly, the present invention is directed to novel recoil inversion assemblies, which reduce recoil generated by blowback of the propellant gases, as well as their use in propellant-based projectile weapons. Such novel weapons afford reduced recoil, muzzle flip, and muzzle climb, and therefore exhibit improved manageability as compared with current related weapons, particularly when utilizing high powered ammunition. In particular, the recoil inversion assemblies of the present invention further comprise novel delayed-blowback assemblies affording utility with larger caliber ammunition.

The present invention, including recoil inversion assemblies, propellant-based projectile weapons incorporating these assemblies, delayed-blowback assemblies, and methods related thereto will be described with reference to the following definitions that, for convenience, are set forth below. Unless otherwise specified, the below terms used herein are defined as follows:

I. Definitions

As used herein, the term "a," "an," "the" and similar terms used in the context of the present invention (especially in the context of the claims) are to be construed to cover both the singular and plural unless otherwise indicated herein or clearly contradicted by the context.

The term "ammunition" is art-recognized, and is used herein to describe a projectile with its fuse, propelling charge, or primer for use in firing from a weapon. Ammunition includes packaging of these components together, e.g., cartridges, or separately.

The term "blowback" is art-recognized, and describes the process in which gases expand or travel in a direction opposite to the gases escaping in the direction of the projectile through the barrel once the ammunition is fired. The principal of blowback has been used to define a system of operation for self-loading weapons, e.g., firearms, which obtain energy from the motion of the rearward expanding propellant gases created by the ignition of the propellant.

The term "delayed-blowback" is art-recognized, and describes the property of a system of delayed or retarded blowback requiring the striker, e.g., associated with a bolt, to overcome some initial resistance while not fully locked, typically used for more powerful rounds of ammunition or for lighter operating mechanisms.

The term "cannon" is art-recognized, and describes a piece of artillery that uses gunpowder or other explosive-based propellants to launch a projectile, which may or may not be explosive. Cannon vary in caliber, range, mobility, rate of fire, angle of fire, and firepower.

The term "cartridge" is art-recognized, and is used herein to describe a type of ammunition, which packages a bullet or shot, a propellant substance (e.g., smokeless powder or black powder) and a primer within a metallic, paper, or plastic case that is made to fit within the firing chamber of a weapon. The primer is a small charge of an impact-sensitive or electric-sensitive chemical mixture that can be located at the center of the case head (centerfire ammunition), inside a rim (rim-fire ammunition), or in a projection such as in a pin-fire or teat-fire cartridge.

The terms "muzzle brake" or "recoil compensator" is a device connected to the muzzle of a weapon, e.g., firearm or cannon, that redirects propellant gases escaping from the barrel intended to counter recoil and unwanted rising of the barrel during rapid fire.

The term "manageability" is used herein to describe characteristic of the degree of control and manipulation the user is able to maintain when a weapon is fired. In particular, a weapon that stays more controlled and is easier to manipulate, e.g., having less muzzle flip and/or less felt recoil, is considered to have increased or greater manageability.

The language "propellant-based projectile weapon" is used herein to describe weapons that fire ammunition comprising a projectile using expanding gases created by the ignition of a propellant, e.g., smokeless powder or black powder.

The term "rearward" or "backward" are used herein in reference to the weapon and describe the direction of the blowback force or initial momentum of the recoil. Such direction reference is well understood by the ordinarily skilled artisan.

The term "recoil" is art-recognized, and describes the backward movement of a weapon, e.g., gun, when it is discharged, caused by momentum. In this way, the recoil momentum acquired by the weapon exactly balances the forward momentum of the projectile and exhaust gases based upon the law of conservation of momentum. In known weapons, the recoil momentum is transferred to the ground through the body of the shooter; while in heavier guns such as mounted machine guns or cannons, recoil momentum is transferred to the ground through the mount. In contrast, the weapons of the present invention afford recoil inversion that utilize the recoil inversion assemblies described herein to transfer the recoil forward in the direction of the exiting projectile.

The language "recoil inversion" or inverting recoil" are used herein to describe the transfer of blowback force from rearward direction to the forward direction, i.e., at angles that are acute to the barrel (e.g., less than 90 degrees as measured from the barrel of the weapon. The language recoil inversion includes both 1) partial recoil inversion, where only a portion of the full recoil is transferred to the recoil spring, and 2) complete recoil inversion, where the full recoil is transferred to the recoil spring.

The term "significantly" as used herein in the language "muzzle rise is significantly reduced," would indicate that the muzzle rise would be reduced to a level that would be noteworthy by the ordinarily skilled artisan. In particular embodiments, the term significantly would be used for a change in the muzzle rise of greater than 5%, e.g., greater than 10%, e.g., greater than 15%, e.g., greater than 20%, e.g., greater than 25%, e.g., greater than 30%, e.g., greater than 35%, e.g., greater than 40%, e.g., greater than 45%, e.g., greater than 50%, e.g., greater than 60%, e.g., greater than 70%, e.g., greater than 80%, e.g., greater than 90%.

II. Recoil Inversion Assembly of the Invention

One embodiment of the present invention provides a recoil inversion assembly of a propellant-based projectile (PBP) weapon designed with an inversion construct, such that the blowback from a projectile propelled from a barrel of a propellant-based projectile (PBP) weapon is transferred through the recoil inversion assembly to a recoil spring positioned at an angle that is acute to the barrel, and thereby inverting the recoil. The inversion construct may be any mechanism that is useful to rotationally convert the linear blowback force in order to redirect the recoil partially of completely in a direction that is acute the barrel. Moreover, such angle is calculated measuring from the barrel to the path of the vector of force redirection (e.g., in the path of recoil spring), which is less than the 90 degrees (perpendicular) from the barrel. In certain embodiments, the inversion construct may be a gear assembly inversion mechanism or an inversion lever with a fulcrum.

In certain embodiments of the recoil inversion assembly, the blowback from a projectile propelled from a barrel of a propellant-based projectile (PBP) weapon is transferred through the recoil inversion assembly to a recoil spring positioned at an angle that is between 0 degrees and 90 degrees from the barrel (i.e., excluding 0 and 90 degrees), and thereby partially inverting the recoil. In particular embodiments, the angle is between 0 degrees and 46 degrees from the barrel, e.g., 45 degrees. In particular embodiments, the angle is between 0 degrees and 25 degrees from the barrel. In particular embodiments, the angle is between 0 degrees and 15 degrees from the barrel.

In certain embodiments of the recoil inversion assembly, the blowback from a projectile propelled from a barrel of a propellant-based projectile (PBP) weapon is transferred through the recoil inversion assembly to a recoil spring positioned at an angle that is zero degrees from the barrel, and thereby completely inverting the recoil.

The recoil inversion assemblies of the present invention may be useful in any propellant-based projectile (PBP) weapon that uses the energy of the fired ammunition, e.g., cartridge, to cycle the action of the weapon and advance the next available ammunition round into position for firing. Such weapons may be referred to as automatic, e.g., semi-automatic, weapons. In particular embodiments, the PBP weapon may be selected from handguns; sub guns or sub-machine guns; carbines; rifles; machine guns, e.g., light or heavy; shotguns; naval guns, tank guns, or aircraft guns; and cannons, howitzers, or other similar artillery systems.

Depending on the PBP weapon, and the caliber of the ammunition, a system of delayed or retarded blowback may be used in combination with the recoil inversion assembly, requiring the striker to overcome some initial resistance. Such systems are well-known, and include, but are not limited to roller delayed, lever delayed, gas delayed, chamber-ring delayed, toggle delayed, screw delayed, and breech block based such as hesitation locked and toggle delayed. In certain embodiments of the recoil inversion assembly, the recoil inversion assembly includes a novel pivot pin delayed-blowback assembly comprising a transfer arm pivoting pin aligned with an inclined rod (e.g., one or more inclined rods, e.g., two inclined rods) positioned horizontally with the direction of the blowback upon which the pivoting pin advances at a speed correlated with the angle formed by the inclined rod and the direction of the advancing pivoting pin until the pivoting pin reaches the end of the rod allowing the movement of the pivoting pin in a direction parallel to the original direction of the blowback, e.g., to establish a pre-selected delayed-blowback, e.g., based on the caliber of ammunition. In certain embodiments, the pivoting pin allows the rotation of the transfer arm while maintain the ability to conserve horizontal momentum. In specific embodiments, the pivoting pin is the same as the first lever-pivot pin. In certain embodiments, the angle and length of the inclined rod is selected based on the desired amount of delay, e.g., as needed based on the caliber of the ammunition. In certain embodiments, the angle of the inclined rod may be adjustable by a user of a weapon, e.g., which can adjust the blowback delay. In certain embodiments, the inclined rod may be used to keep the striker in repeatable identical location, e.g., by using a divot/notch selected and positioned on the inclined rod.

A. Gear Assembly Inversion Mechanism

In certain embodiments of the present invention, the inversion construct comprises a gear assembly. In particular embodiments, the inversion construct comprising a gear assembly comprises a rack and pinion, e.g., multiple racks and a pinion. For example, such rack and pinion gears are used to transfer the linear blowback force through a rack to the rotary motion of the pinion, which may transfer the force directly or through another rack into a recoil spring positioned at an angle that is acute to the barrel, and thereby inverting the recoil. Such motion is reversed to reset the striker into position for firing another projectile.

B. Inversion Lever and Fulcrum Mechanism

In certain embodiments of the present invention, the inversion construct comprises an inversion lever and fulcrum. For example, transfer arms are used to transfer the linear blowback force through one end of an inversion lever and fulcrum to the other end of the inversion lever, which may transfer the force directly or through another transfer arm into a recoil spring positioned at an angle that is acute to the barrel, and thereby inverting the recoil.

As such, one embodiment of the present invention provides a recoil inversion assembly of a propellant-based projectile (PBP) weapon designed with an inversion construct comprising an inversion lever and a fulcrum, wherein the inversion lever is linked on one end of the inversion lever through a first lever-pivot pin to one or more transfer arms linked to a striker through a striker-pivot pin, and wherein the opposite end of the inversion lever is linked through a second lever-pivot pin to one or more transfer arms linked to a slide (e.g., a collar slide) suitable for sliding along a recoil guide rod and compressing a recoil spring, such that the blowback from a projectile propelled from a barrel of a propellant-based projectile (PBP) weapon is transferred through the recoil inversion assembly to a recoil spring positioned at an angle that is acute to the barrel, and thereby inverting the recoil.

i. Inversion Lever

The inversion lever and a fulcrum form one embodiment of an inversion construct of the invention. The inversion lever is linked on one end of the inversion lever through a first lever-pivot pin to one or more transfer arms linked to a striker through a striker-pivot pin, and the opposite end of the inversion lever is linked through a second lever-pivot pin to one or more transfer arms linked to a slide (e.g., a collar slide) suitable for sliding along a recoil guide rod and compressing a recoil spring. In certain embodiments, the fulcrum is positioned in line with the striker. The length, and shape of the inversion lever may vary, e.g., based on the desired outcome or space constraints, and is within the skill of the ordinarily skilled artisan in light of the present disclosure In certain embodiments, a tension spring is positioned between the first lever-pivot pin and the fulcrum, e.g., to maintain the position of the first-lever pin against the inclined rod when the striker is in position to fire the projectile.

ii. Transfer Arms

The transfer arms are used to link the striker assembly and the recoil spring through the inversion lever. Each link to the inversion lever may comprise one or more transfer arms. These transfer arms may be straight or bent (e.g., at fixed angles or curvilinearly). In certain embodiments, the transfer arms linking the inversion lever and the collar slide are bent at fixed angles in at least one location, e.g., two locations. The length, and shape of each transfer arm link may vary, e.g., based on the desired outcome or space constraints, and is within the skill of the ordinarily skilled artisan in light of the present disclosure.

iii. Recoil Guide Rod with Recoil Spring

The recoil guide rod and recoil spring are used to absorb the recoil. They may be positioned at any acute angle as measured from the barrel of a weapon, such that the blowback from a projectile propelled from a barrel of a propellant-based projectile (PBP) weapon is transferred through the recoil inversion assembly to a recoil spring positioned at an angle that is acute to the barrel, and thereby inverting the recoil. The length of the recoil guide rod and recoil spring may vary, and is selected based on the desired outcome or space constraints, and is within the skill of the ordinarily skilled artisan in light of the present disclosure.

The slide is functionally associated with the recoil spring and is suitable for sliding along the recoil guide rod and compressing the recoil spring. In certain embodiments, the slide may partially encircle the recoil guide rod. In certain embodiments, the slide may completely encircle the recoil guide rod, e.g., a collar slide.

III. Propellant-Based Projectile (PBP) Weapon of the Present Invention

Another embodiment of the present invention provides a propellant-based projectile (PBP) weapon with recoil inversion comprising a frame encapsulating:

a barrel through which rapid expansion of gases are released for propelling a projectile out of the end;

a striker assembly comprising a striker aligned to the end of the barrel for striking the igniter of propellant (e.g., a primer) used to propel the projectile out of the end of the barrel;

a trigger assembly that actuates the striker to strike the igniter of the propellant; and a recoil inversion assembly of the present invention, as described herein. As such, in certain embodiments, recoil inversion assembly is designed with an inversion construct comprising an inversion lever and a fulcrum (e.g., a fulcrum positioned in line with the striker), wherein the inversion lever is linked on one end of the inversion lever through a first lever-pivot pin to one or more transfer arms linked to the striker through a striker-pivot pin, and wherein the opposite end of the inversion lever is linked through a second lever-pivot pin to one or more transfer arms linked to a slide (e.g., a collar slide) suitable for sliding along the recoil guide rod and compressing the recoil spring, such that the blowback from the projectile propelled through the barrel is transferred through the recoil inversion assembly to the recoil spring positioned at an angle that is acute to the barrel, and thereby inverting the recoil. In certain embodiments, the recoil inversion assembly includes a pivot pin delayed-blowback assembly comprising a transfer arm pivoting pin aligned with an inclined rod (e.g., one or more inclined rods, e.g., two inclined rods) positioned horizontally with the direction of the blowback upon which the pivoting pin advances at a speed correlated with the angle formed by the inclined rod and the direction of the advancing pivoting pin until the pivoting pin reaches the end of the rod allowing the movement of the pivoting pin in a direction parallel to the original direction of the blowback, e.g., to establish a pre-selected delayed-blowback. In particular embodiments, the pivoting pin is the same as the first lever-pivot pin.

In certain embodiments of the present invention, the striker-pivot pin is fixed into an inset rail slot in the frame, directing the movement of the striker-pivot pin along the inset rail.

In certain embodiments of the present invention, the PBP weapon is a cartridge-based projectile weapon.

The propellant-based projectile (PBP) weapons of the present invention, are not limited by size or shape. The propellant-based projectile (PBP) weapons of the present invention may be selected from any weapon that uses the energy of the fired ammunition, e.g., cartridge, to cycle the action of the weapon and advance the next available ammunition round into position for firing. Such weapons may be referred to as automatic, e.g., semi-automatic, weapons. In particular embodiments, the PBP weapon may be selected from handguns; sub guns or submachine guns; carbines; rifles; machine guns, e.g., light or heavy; shotguns; naval guns, tank guns, or aircraft guns; and cannons, howitzers, or other similar artillery systems.

A. Frame

The frame is the shell of the weapon that contains, encloses, or encapsulates all components and mechanisms of the weapon, and provides the mounting platform for any mounted components. In certain embodiments, such mounting may be accomplished through frame integrated structures that complement the internal components, e.g., through inset rail features. For example, in particular embodiments, the striker-pivot pin is fixed into an inset rail slot in the frame, directing the movement of the striker-pivot pin along the inset rail. In certain embodiments, the inlet rail slot may be used to keep striker in repeatable identical location, e.g., by using a divot/notch selected and positioned on the inlet rail slot.

In particular embodiments, the frame is made of forged, machined, or stamped steel or aluminum.

B. Barrel

The frame encapsulates a barrel through which rapid expansion of gases are released for propelling a projectile out of the end. A barrel is a part of a weapon, e.g., a firearm or artillery pieces, that is the straight tube from which the projectile is fired. In particular embodiments, the barrel is made of rigid high-strength metal, through which a deflagration or rapid expansion of gases are released in order to propel a projectile out of the end at a high velocity.

The position of the barrel of the gun may be described relative to the recoil spring, where a barrel positioned at 12 o'clock has the barrel positioned above the recoil spring, and a barrel positioned at 6 o'clock has the barrel positioned below the recoil spring. In certain embodiments of the invention, the barrel is positioned at the 6 o'clock position in the frame. In particular embodiments, the 6 o'clock position of the barrel may be advantageous for additionally reducing the muzzle flip.

C. Striker Assembly

The frame encapsulates a striker assembly comprising a striker aligned to the end of the barrel for striking the igniter of propellant (e.g., a primer) used to propel the projectile out of the end of the barrel. The striker assembly may further comprise a bolt that is associated with the striker. As such, in certain embodiments, the striker assembly further comprises a bolt, e.g., through which the striker runs.

D. Trigger Assembly

Trigger assemblies are well known in the art, any of which may be used herein (i.e., provided that they do not significantly inhibit or prevent the features of the weapons or recoil inversion assemblies explicitly described herein), and are also encapsulated in the frame of the weapons of the present invention. Such trigger assemblies are mechanisms that actuate the striker to strike the igniter of the propellant. In particular embodiments, a trigger action device releases a spring-loaded mechanism, lever, or a similar arrangement to activate the firing mechanism, and cause the striker to ignite the propellant. In specific embodiments the trigger assembly is single action. In specific alternative embodiments the trigger assembly is double action.

E. Additional Components of the Weapons of the Present Invention

The components of the weapons of the present invention may further comprise additional relevant components that afford fully functional weapons within the scope of the ordinarily skilled artisan in light of the disclosure of the present invention; and the invention as described is not intended to exclude such components, but rather to provide disclosure related to the core elements of the propellant-based projectile (PBP) weapons of the present invention. As such, in certain embodiments, the propellant-based projectile (PBP) weapons of the present invention may incorporate additional design elements that do not significantly inhibit or prevent the features of the weapons or recoil inversion assemblies explicitly described herein.

The mechanisms and embodiments of the invention can be used to complement or improve existing or conventional firearms and can be combined with various arrangements, attachments, and combinations, including without limitation internal release systems, loading systems, ejection systems, gas injection systems, recoil reduction systems, muzzle brakes, sighting systems, tripods, mounting systems, and firing mechanisms.

In certain embodiments of the present invention, the PBP weapon further comprises a projectile, e.g., along with a propellant. In particular embodiments, the projectile is a part of a cartridge, e.g., a bullet.

III. Methods of the Invention

A. Methods of Preparation

It should be readily understood by the ordinarily skilled artisan in light of the disclosure provided herein that a propellant-based projectile (PBP) weapon constructed in accordance with the present invention can be manufactured in a variety of shapes and sizes, and can be formed from wood, steel (e.g., high carbon, heat treated steel), polymer plastic aluminum alloys, as well as other suitable materials or combinations thereof. Moreover, the forming process can also vary to include methods such as using castings and machine injection molding along with finishing with stainless finish alloys (e.g., nickel and chrome plating), thermoforming, injection molding, or blow molding.

B. Methods of Improving Manageability of a Propellant-Based Projectile Weapon

Another embodiment of the present invention provides a method of improving manageability, e.g., reducing recoil or muzzle redirection, of a propellant-based projectile (PBP) weapon comprising the steps of incorporating a recoil inversion assembly into a PBP weapon according to the present invention, such that upon firing of the PBP weapon, the manageability of the weapon is improved.

With respect to the step of "incorporating," such term is used to describe the design and placement of the recoil inversion assembly within the structure of a PBP weapon such that the assembly is capable of recoil inversion.

In certain embodiments of the methods of the present invention, muzzle rise (e.g., muzzle flip and muzzle climb) is significantly reduced as compared to the same weapon without the recoil inversion assembly, e.g., reduced by 10% or greater, e.g., reduced by 20% or greater, e.g., reduced by 30% or greater, e.g., reduced by 40% or greater, e.g., reduced by 50% or greater.

EXEMPLIFICATION

Having thus described the invention in general terms, reference will now be made to the accompanying drawings of exemplary embodiments, which are not necessarily drawn to scale, and which are not intended to be limiting in any way.

In this respect, it is to be understood that the invention is not limited in its application to the details of construction and to the arrangements of the components set forth in the following description or illustrated in the Figures. The invention is capable of other embodiments and of being practiced and carried out in various ways. Also, it is to be understood that the phraseology and terminology employed herein are for the purpose of description and should not be regarded as limiting.

Figure 2:
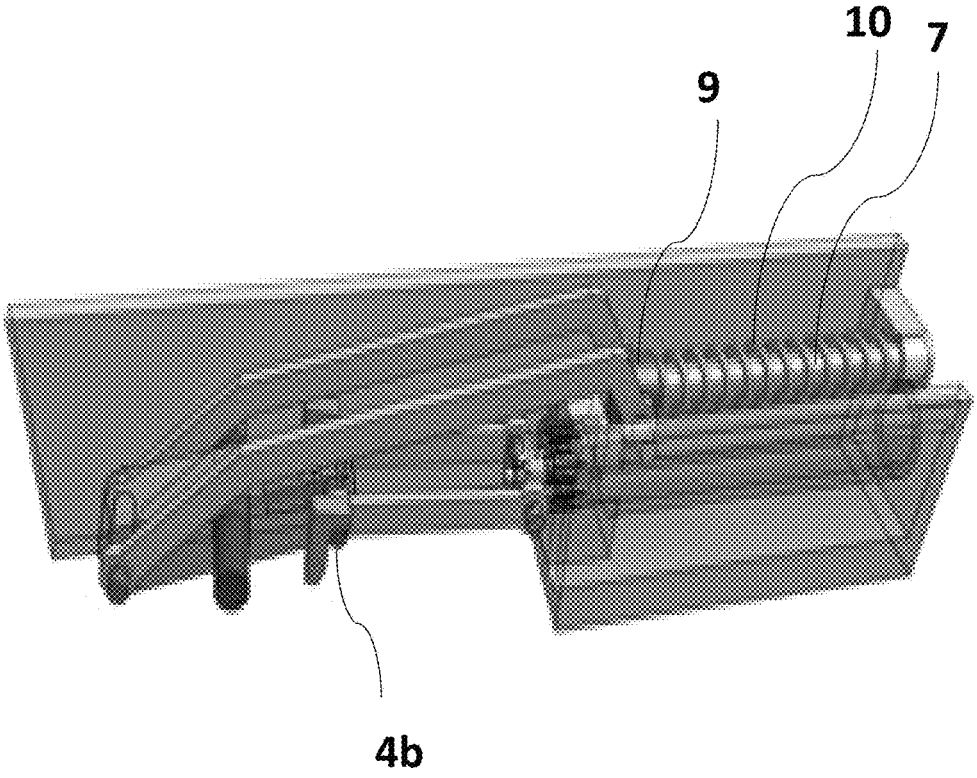
FIG. 2 is a top-down angled side perspective view of a particular embodiment of a recoil inversion assembly inside a PBP weapon of the invention comprising a delayed-blowback assembly of the present invention depicted with a striker in firing position.
Figure 4:
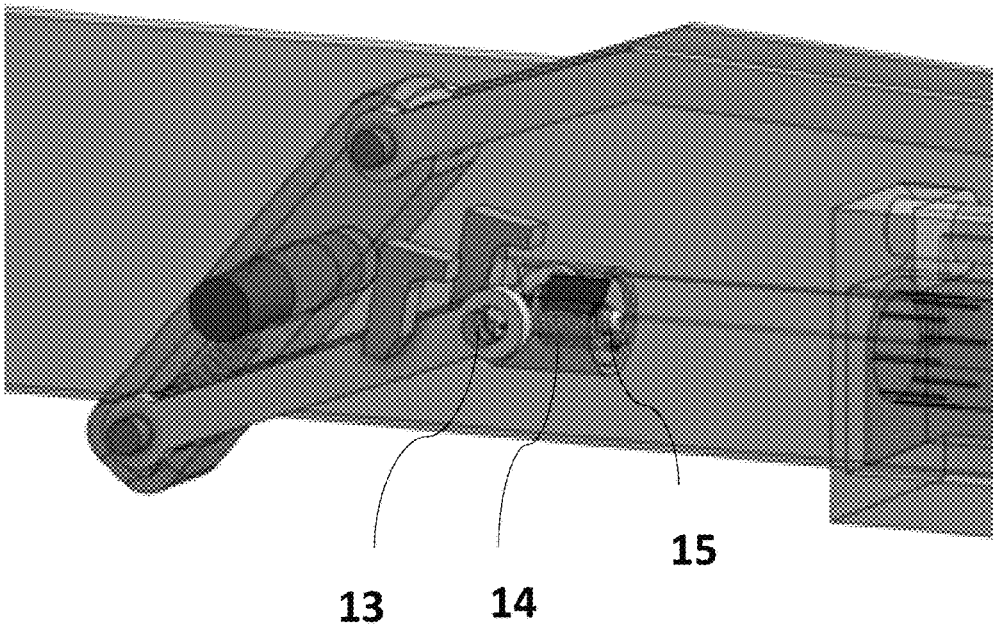
FIG. 4 is a front angle side perspective view of the particular embodiment of a recoil inversion assembly inside a PBP weapon of FIG. 3, focused only the inversion lever transition position.

FIG. 1 is a rear angle side perspective view of a particular embodiment of a recoil inversion assembly inside a PBP weapon of the invention comprising a delayed-blowback assembly of the present invention depicted with a striker in firing position. The inversion construct comprises inversion lever 9 that is capable of rotating about fulcrum 3. Inversion lever 9 is linked on one end of the inversion lever through a first lever-pivot pin 4*b* to two transfer arms 1 linked to striker 15 (located within bolt 14) through striker-pivot pin 13 (See FIG. 4). The opposite end of inversion lever 9 is linked through a second lever-pivot pin 4*a* to two transfer arms 6 linked to a collar slide 9 (See FIG. 2) suitable for sliding along a recoil guide rod 7 and compressing a recoil spring 10 (See FIG. 2), such that the blowback from a projectile propelled from a barrel of a propellant-based projectile (PBP) weapon is transferred through the recoil inversion assembly to a recoil spring 10 positioned at an angle that is 0 degrees as measured from barrel 5, and thereby completely inverting the recoil.

The fulcrum 3 is positioned in line with the striker 20. Transfer arms 6, linking the inversion lever and collar slide 9 are bent at fixed angles in at least two locations with angles suitable to link to the collar slide positioned at an angle that is 0 degrees as measured from barrel 5.

The recoil inversion assembly includes a pivot pin delayed-blowback assembly comprising a transfer arm pivoting pin 4*b*, which is the same as the first lever-pivot pin, aligned with a pair of inclined rods 2 positioned horizontally with the direction of the blowback upon which the pivoting pin 4*b* advances at a speed correlated with the angle formed by the inclined rods 2 and the direction of the advancing pivoting pin 4*b* until the pivoting pin reaches the end of the rod allowing the movement of the pivoting pin in a direction parallel to the original direction of the blowback. Moreover, the angle and length of the inclined rods 2 with respect to pivoting pin 4*b* is selected based on the desired amount of delay, e.g., based on the caliber of ammunition.

Figure 3:
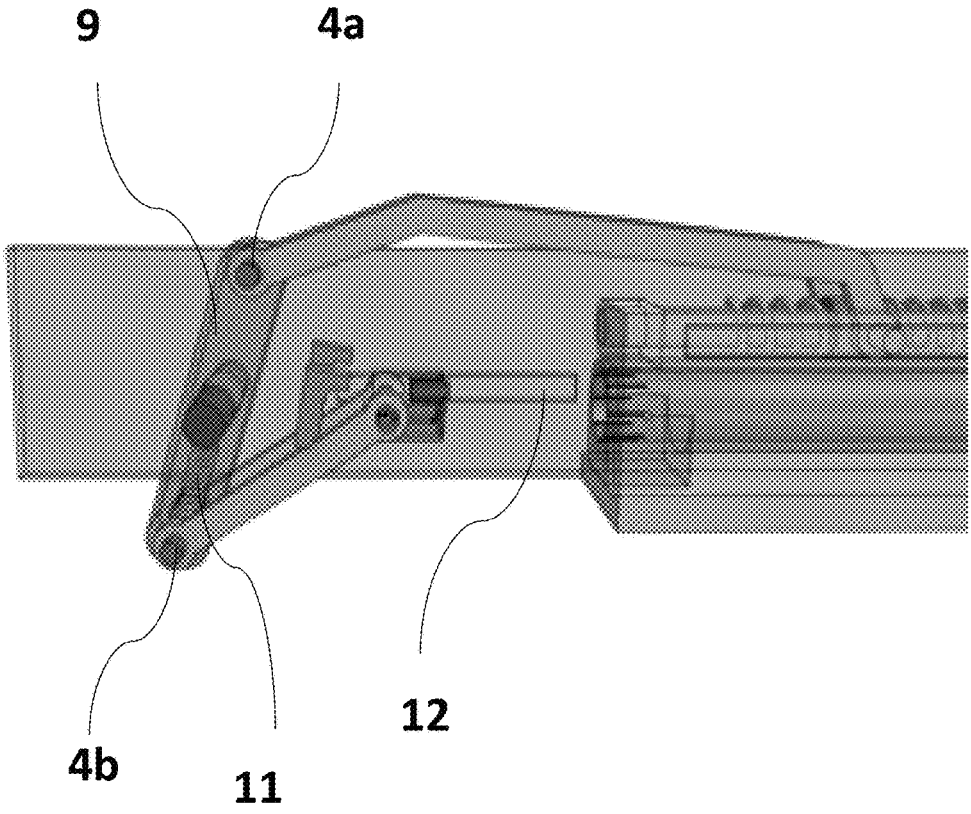
FIG. 3 is a side perspective view of a particular embodiment of a recoil inversion assembly inside a PBP weapon of the invention comprising a delayed-blowback assembly of the present invention depicting the inversion lever transferring the recoil from the striker moving along an inset rail slot in the frame to a recoil spring positioned at an angle that is acute to the barrel, i.e., 0 degrees, and thereby completely inverting the recoil.

FIG. 3 is a side perspective view of a particular embodiment of a recoil inversion assembly inside a PBP weapon of the invention comprising a delayed-blowback assembly of the present invention depicting the inversion lever 9 transferring the recoil from the striker 15 with striker-pivot pin 13 moving along inset rail slot 12 in frame 8 to a recoil spring 10 positioned along a recoil guide rod 7 at an angle that is acute to barrel 5, i.e., 0 degrees, and thereby completely inverting the recoil. The recoil spring 10 is compressed (even though the spring is not depicted as compressed in the figure) and then the act of decompressing the spring (to return to an uncompressed state) returns components to their original position by acting in reverse, and cycles another round into barrel 5.

Further, tension spring 11 is positioned between the first lever-pivot pin 4*b* and the fulcrum 3 to maintain the position of the first-lever pivoting pin 4*a* against the inclined rods 2 when the striker 15 is in position to fire the projectile.

Figure 5:
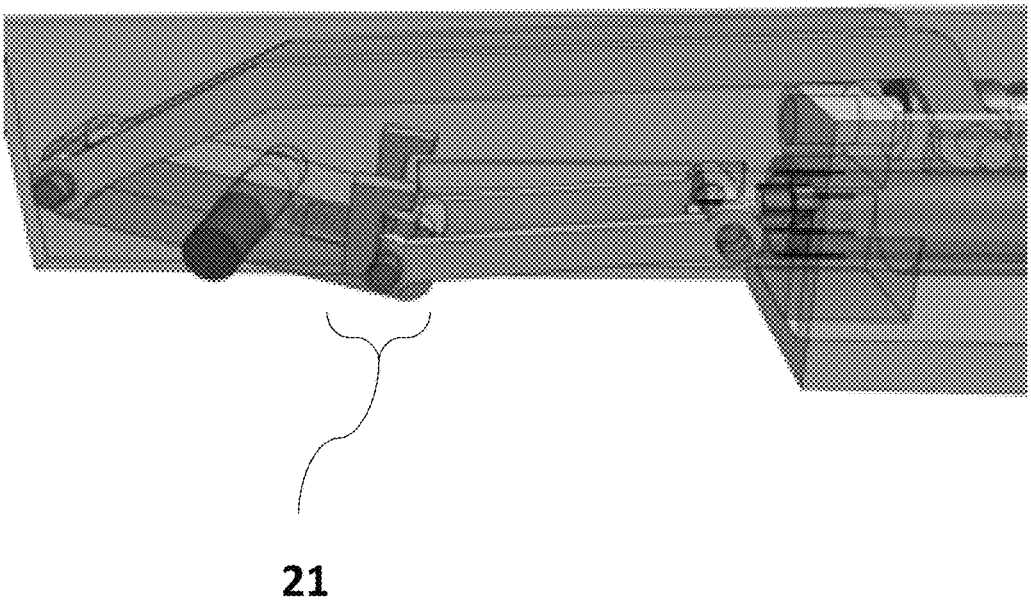
FIG. 5 is a side perspective view of a particular embodiment of a recoil inversion assembly inside a PBP weapon of the invention, depicting the action of a delayed-blowback assembly of the present invention wherein a projectile has been fired from the weapon, and the transfer arm pivoting pin has almost reached the end of the inclined rod.

FIG. 5 is a side perspective view of a particular embodiment of a recoil inversion assembly inside a PBP weapon of the invention, depicting the action of a delayed-blowback assembly of the present invention wherein a projectile has been fired from the weapon, and first lever-pivot pin 4*b* has almost reached the end of the inclined rod in region 21 allowing the movement of the first lever-pivot pin in a direction parallel to the original direction of the blowback.

i. Recoil Inversion Assembly in Action

In action, immediately after the ammunition is fired through barrel 5 by ignition of the propellant by striker 15, striker 15 associated with bolt 14 are directed rearward. Therefore, the striker-pivot pin 13 directs the transfer arms 1 rearward, forcing the first lever-pivot pin 4*b* rearward into inclined rods 2. The blowback delay created by the travel of the first lever-pivot pin 4*b* along the inclined rods may be selected depending on caliber of the ammunition by adjusting the angle and length of the inclined rod with respect to the first lever-pivot pin 4*b*; such delay allows the pressure of the expanding blowback gases to drop to an appropriately safe level. As the first lever-pivot pin 4*b* clears inclined rods 2 and continues moving in the direction parallel to the original blowback force, the striker-pivot pin 13 begins moving along inset rail slot 12 in frame 8, directed rearward, and the first lever-pivot pin 4*b* rotates the inversion lever 9 around fulcrum 3, transferring the blowback force energy to transfer arms 6, which in turn, compresses recoil spring 10 along recoil guide rod 7 via collar slide 9. Upon decompression of the spring, where the spring returns to its uncompressed state, the process reverses itself and the bolt 14 and striker 15, which were positioned rearward along the inset rail slot 12 return to their original position taking a fresh round from the magazine (not pictured) and positioning it into barrel 5 to start the cycle again.

Example 2

Motion Modeling Analysis

The particular embodiment of a PBP weapon of the invention depicted in FIG. 1, comprising a particular recoil inversion assembly of the invention and a delayed-blowback assembly of the present invention was used to establish the mathematical relationships under motion modeling a projectile interacting with a generic nonlinear spring using MATLAB® (The MathWorks, Inc.).

In particular, energy based analysis was used to model a projectile interacting with a generic nonlinear spring. The nonlinear spring modeled different geometries, producing an analysis of the maximum exerted force at the moment of explosion of the primer, for each case. This analysis allowed for the optimization of the geometrical parameters of the inclined rod in order to minimize this exerted force (felt recoil to the shooter). In certain embodiments, it was demonstrated that optimal behavior (reduction of the maximum force by up to 50%) may be achieved for a recoil inversion assembly utilizing nonlinear softening springs.

INCORPORATION BY REFERENCE

The entire contents of all patents, published patent applications and other references cited herein are hereby expressly incorporated herein in their entireties by reference.

EQUIVALENTS

Those skilled in the art will recognize, or be able to ascertain using no more than routine experimentation, numerous equivalents to the specific procedures described herein. Such equivalents are considered to be within the scope of this invention and are covered by the following claims. Moreover, any numerical or alphabetical ranges provided herein are intended to include both the upper and lower value of those ranges, unless clearly contradicted explicitly or by the context. In addition, any listing or grouping is intended, at least in one embodiment, to represent a shorthand or convenient manner of listing independent embodiments; as such, each member of the list should be considered a separate embodiment.

What is claimed is:

1. A recoil inversion assembly of a propellant-based projectile (PBP) weapon designed with an inversion construct comprising an inversion lever and a fulcrum, wherein the inversion lever is linked on one end of the inversion lever through a first lever-pivot pin to one or more transfer arms linked to a striker through a striker-pivot pin, and wherein the opposite end of the inversion lever is linked through a second lever-pivot pin to one or more transfer arms linked to a slide suitable for sliding along a recoil guide rod and compressing a recoil spring, such that the blowback from a projectile propelled from a barrel of a propellant-based projectile (PBP) weapon is transferred through the recoil inversion assembly to a recoil spring positioned at an angle that is acute to the barrel, and thereby inverting the recoil.

2. The recoil inversion assembly of claim 1, wherein the fulcrum is positioned in line with the striker.

3. The recoil inversion assembly of claim 1, wherein the blowback from a projectile propelled from a barrel of a propellant-based projectile (PBP) weapon is transferred through the recoil inversion assembly to a recoil spring positioned at an angle that is between 0 degrees and 90 degrees from the barrel, and thereby partially inverting the recoil.

4. The recoil inversion assembly of claim 1, wherein the blowback from a projectile propelled from a barrel of a propellant-based projectile (PBP) weapon is transferred through the recoil inversion assembly to a recoil spring positioned at an angle that is zero degrees from the barrel, and thereby completely inverting the recoil.

5. The recoil inversion assembly of claim 1, wherein the transfer arms linking the inversion lever and the slide are bent at fixed angles in at least one location.

6. The recoil inversion assembly of claim 1, wherein the recoil inversion assembly includes a pivot pin delayed-blowback assembly comprising a transfer arm pivoting pin aligned with an inclined rod positioned horizontally with the direction of the blowback upon which the pivoting pin advances at a speed correlated with the angle formed by the inclined rod and the direction of the advancing pivoting pin until the pivoting pin reaches the end of the rod allowing the movement of the pivoting pin in a direction parallel to the original direction of the blowback.

7. The recoil inversion assembly of claim 6, wherein pivoting pin is the same as the first lever-pivot pin.

8. The recoil inversion assembly of claim 7, wherein a tension spring is positioned between the first lever-pivot pin and the fulcrum to maintain the position of the first-lever pin against the inclined rod when the striker is in position to fire the projectile.

9. The propellant-based projectile (PBP) weapon of claim 6, wherein the angle and length of the inclined rod is selected based on the desired amount of delay.

10. A propellant-based projectile (PBP) weapon with recoil inversion comprising a frame encapsulating:

a barrel through which rapid expansion of gases are released for propelling a projectile out of the end;

a striker assembly comprising a striker aligned to the end of the barrel for striking the igniter of propellant used to propel the projectile out of the end of the barrel;

a trigger assembly that actuates the striker to strike the igniter of the propellant; and a recoil inversion assembly designed with an inversion construct comprising an inversion lever and a fulcrum, wherein the inversion lever is linked on one end of the inversion lever through a first lever-pivot pin to one or more transfer arms linked to the striker through a striker-pivot pin, and wherein the opposite end of the inversion lever is linked through a second lever-pivot pin to one or more transfer arms linked to a slide suitable for sliding along the recoil guide rod and compressing the recoil spring, such that the blowback from the projectile propelled through the barrel is transferred through the recoil inversion assembly to the recoil spring positioned at an angle that is acute to the barrel, and thereby inverting the recoil.

11. The propellant-based projectile (PBP) weapon of claim 10, wherein the recoil inversion assembly includes a pivot pin delayed-blowback assembly comprising a transfer arm pivoting pin aligned with an inclined rod positioned horizontally with the direction of the blowback upon which the pivoting pin advances at a speed correlated with the angle formed by the inclined rod and the direction of the advancing pivoting pin until the pivoting pin reaches the end of the rod allowing the movement of the pivoting pin in a direction parallel to the original direction of the blowback.

12. The propellant-based projectile (PBP) weapon of claim 11, wherein pivoting pin is the same as the first lever-pivot pin.

13. The propellant-based projectile (PBP) weapon of claim 10, wherein the striker-pivot pin is fixed into an inset rail slot in the frame, directing the movement of the striker-pivot pin along the inset rail.

14. The propellant-based projectile (PBP) weapon of claim 11, wherein the angle and length of the inclined rod is selected based on the desired amount of delay.

15. The propellant-based projectile (PBP) weapon of claim 10, wherein the barrel is positioned at the 6 o'clock position in the frame, with reference to the recoil guide rod.

16. The propellant-based projectile (PBP) weapon of claim 10, wherein the striker assembly further comprises a bolt.

17. The propellant-based projectile (PBP) weapon of claim 10, wherein muzzle rise is significantly reduced.

18. The propellant-based projectile (PBP) weapon of claim 10, wherein the PBP weapon is a cartridge-based projectile weapon.

19. The propellant-based projectile (PBP) weapon of claim 10, further comprising a projectile.

20. The propellant-based projectile (PBP) weapon of claim 19, wherein the projectile is a part of a cartridge.

* * * * *